United States Patent [19]

Shimamura et al.

[11] 4,442,811

[45] Apr. 17, 1984

[54] METHOD AND APPARATUS FOR EXPEDITING THE STARTING OF AN INTERNAL COMBUSTION ENGINE

[75] Inventors: Haruo Shimamura, Kawashima; Yasuhiro Yamaoka, Niiza, both of Japan

[73] Assignee: Honda Giken Koyo Kabushiki Kaisha, Tokyo, Japan

[21] Appl. No.: 359,195

[22] Filed: Mar. 18, 1982

[30] Foreign Application Priority Data

Mar. 31, 1981 [JP] Japan ..... 56-45874[U]

[51] Int. Cl.[3] ..... F02M 1/10; F02M 19/12

[52] U.S. Cl. ..... 123/376; 123/339; 123/DIG. 11

[58] Field of Search ..... 123/142.5 R, DIG. 11, 123/376, 377, 378

[56] References Cited

U.S. PATENT DOCUMENTS 3,741,177 6/1973 Schultz ..... 123/DIG. 11
3,760,785 9/1973 Harrison et al. ..... 123/DIG. 11
3,971,356 7/1976 Schlage ..... 123/DIG. 11
4,128,087 12/1978 Hayashi et al. ..... 123/DIG. 11
4,168,681 9/1979 Kawai et al. ..... 123/DIG. 11

*Primary Examiner*—Ira S. Lazarus
*Attorney, Agent, or Firm*—Posnack, Roberts, Cohen & Spiecens

[57] ABSTRACT

Apparatus and method for expediting the starting of an internal combustion engine in which a vacuum-operated throttle actuator is controlled by a vacuum passage connected therewith and extending from an intake vacuum outlet located adjacent to the throttle valve. According to the invention, a second vacuum passage to the actuator communicates with the intake duct downstream of the throttle valve and a solenoid type switching valve is arranged between the two vacuum passages so that, when a warmed engine is restarted, the actuator is fed with vacuum through the second passage to actuate the throttle valve to a more open position than its normal idling position to yield a mixture of optimal air fuel ratio.

11 Claims, 1 Drawing Figure

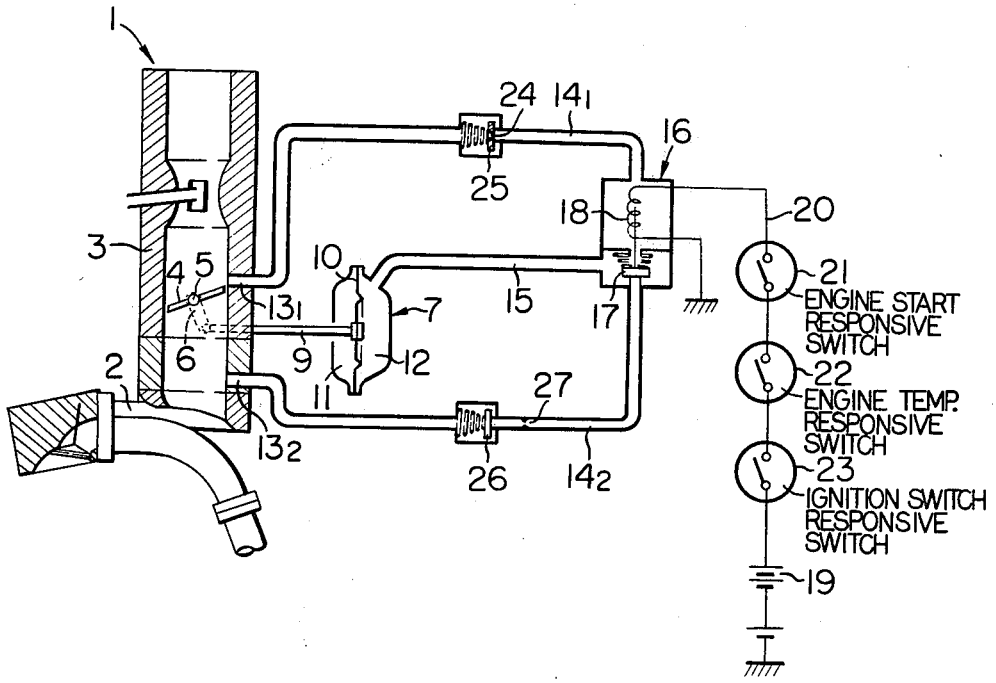
1
24
14₁
16
25
18
20
3
4
5
10
13₁
7
15
17
21
ENGINE START RESPONSIVE SWITCH
6
9
12
2
11
27
22
ENGINE TEMP. RESPONSIVE SWITCH
13₂
26
14₂
23
IGNITION SWITCH RESPONSIVE SWITCH
19

METHOD AND APPARATUS FOR EXPEDITING THE STARTING OF AN INTERNAL COMBUSTION ENGINE

FIELD OF THE INVENTION

This invention relates to methods and apparatus for expediting the starting of an internal combustion engine and, more particularly, to the type adapted to enable restarting an engine, which has been warmed up and still remains at an elevated temperature, easily and without fail by optimizing the air fuel ratio of the mixture to be fed to the engine.

DESCRIPTION OF THE PRIOR ART

In general, when an engine, which has been heated to its operative elevated temperature condition and then shut off, is restarted before the engine temperature drops to any substantial extent, the engine is sometimes fed with an over-rich mixture due to fuel evaporation in the intake system during the engine stoppage and thus the engine is not easily started into a fullfiring operation. To overcome this difficulty, it is necessary to increase the throttle opening to an appropriate extent to prevent formation of an over rich mixture.

On the other hand, apparatus is known which is usable with an internal combustion engine and particularly with an automotive engine for reducing the amount of unburned products in the exhaust when the engine is slowing down or for improving the engine performance during idling, particularly when an auxiliary unit such as an air conditioner compressor or a power steering system is put into operation or when an automatic transmission is shifted into its drive range; such apparatus includes a vacuum-operated actuator connected to the throttle valve, arranged in the intake system of the engine, and operable to open the throttle valve to a predetermined throttle position and a vacuum passage extending from a vacuum outlet port, formed at an appropriate location in the intake system, to the vacuum chamber in the vacuum-operated actuator and is arranged so that, as occasion calls during engine operation, the intake vacuum is fed into the vacuum chamber, causing the vacuum-operated actuator to act to correct the opening of the throttle valve in increasing direction.

SUMMARY OF THE INVENTION

An object of the present invention is to provide a simple and effective apparatus of the general type described which is adapted to automatically open the throttle valve by an appropriate extent to prevent formation of an over rich air fuel mixture, particularly when the engine is started at its ordinary elevated temperature condition, thereby to enable the driver to start the engine easily and with certainty despite its elevated temperature condition.

It is within the contemplation of the invention to utilize the vacuum-operated throttle actuator in any existing device of the general kind.

The foregoing and other objects and advantages of the present invention will become apparent by reference to the following description taken in conjunction with the accompanying drawing.

BRIEF DESCRIPTION OF THE DRAWING

In the drawing, the sole FIGURE is a diagrammatic illustration of a preferred embodiment of the present invention.

DESCRIPTION OF THE PREFERRED EMBODIMENT

Referring to the drawing, reference numeral 1 indicates the intake system of an internal combustion engine including an intake duct 2 connected to the suction port of the engine and a carburetor 3 arranged in the upstream end of the intake duct. The carburetor 3 is provided therein with a throttle valve 4 as is conventional, which is of the butterfly type and rotatable to open and close with rotation of a valve shaft 5 secured thereto. Secured to the valve shaft 5 at its external end is a throttle-opening correction lever 6 which is connected by a link 9 to a diaphragm 10 arranged in a vacuum-operated actuator 7. The interior of the actuator casing is divided by the diaphragm 10 into two chambers, namely an atmospheric chamber 11 lying on the throttle valve side of the diaphragm 10 and a vacuum chamber 12 on the opposite side thereof. It will be readily noted that, when the vacuum chamber 12 is fed with a vacuum above a definite level, the diaphragm 10 acts, under the effect of the vacuum, through the throttle-opening correcting lever 9 to open the throttle valve to a predetermined position slightly beyond its normal idling position.

A first and a second vacuum outlet port $13_1$ and $13_2$ are provided in the side wall of intake duct 2 for sensing the intake vacuum to be fed into the vacuum chamber 12 of the actuator 7. Specifically, the first vacuum outlet port $13_1$ is located at a point slightly upstream of the adjacent edge of the throttle valve 4 when held in the idling throttle position and, when the throttle valve 4 is actuated to open, port $13_1$ is located on the downstream side of the actuated throttle valve. The second vacuum outlet port $13_2$ is located at a point always downstream of the throttle valve 4. Connected to the vacuum outlet port $13_1$ and $13_2$ are the respective upstream ends of a first and a second vacuum passage $14_1$ and $14_2$ which are both connected at their downstream ends to a vacuum feed passage or pipe 15 through the intermediary of an electromagnetic switching valve 16. The switching valve 16 includes a valve element 17 movable to open and close the two vacuum passages $14_1$ and $14_2$ alternately with each other under the control of a solenoid 18 operatively connected with the valve element 17, and is arranged so that, upon de-energization of the solenoid 18, the first vacuum passage $14_1$ is opened to communicate with the vacuum feed passage 15 and the second vacuum passage $14_2$ closed off while, upon energization of the solenoid 18, the first vacuum passage $14_1$ is closed off and the second one $14_2$ opened.

Reference numeral 20 indicates an energizing circuit connecting the solenoid 18 to a voltage source 19 and including series-connected switches 21,22 and 23. Switch 21 is an engine-start responsive switch adapted to close upon sensing the running state of the engine cranking unit such as a starting motor; switch 22 is an engine-temperature responsive switch adapted to close upon detection of engine temperature exceeding a predetermined level (for example, the temperature of engine coolant exceeding 72° C.); and switch 23 is a main switch adapted to open and close with operation of the ignition switch of the engine. As will readily be noted, the solenoid 18 is energized only when the three switches 21,22 and 23 are all closed.

Inserted in the first vacuum passage $14_1$ is a unidirectional valve 25 including an orifice 24 for allowing flow of air through the vacuum passage $14_1$ only in the direction toward the first vacuum outlet port $13_1$. A unidirectional valve 26 and an orifice 27 are inserted in the second vacuum passage $14_2$ in series with one another, the valve 26 allowing air flow through the second vacuum passage $14_2$ solely in the direction toward the second vacuum outlet port $13_2$.

The operation of the preferred embodiment described above will next be explained hereafter.

In the device of the present invention, the vacuum-operated actuator 7 is arranged to serve two distinct functions; first it serves, when the engine slows down with the accelerator pedal released, the function, known per se in the art, of causing the now rapidly closing throttle valve 4 to stop in a predetermined limited-opening position and then allowing the throttle valve to close further slowly against a definite resistance now presented to the closing movement thereby to prevent any rapid drop in volumetric efficiency of the engine which would cause an increase in the amount of unburned products in the engine exhaust. A second function, characteristic of the device of the present invention, is to actuate the throttle valve to the predetermined position of limited opening when the engine, at an elevated temperature condition, is restarted thereby to prevent the starting mixture from being excessively enriched and thus to improve the starting performance of the engine at elevated temperatures. These two functions of the throttle actuator will be described below in further detail.

THE FIRST FUNCTION

During engine operation, the engine-start responsive switch 21 remains open and the solenoid 18 de-energized allowing the switching valve 16 to remain in a position to keep open the first vacuum passage $14_1$, as shown. Accordingly, when the throttle valve 4 is opened past the first vacuum outlet port $13_1$ from the downstream side to the upstream side thereof, the intake vacuum is fed through the first vacuum outlet $13_1$ into the first vacuum passage $14_1$ and thence through the vacuum feed passage 15 into the vacuum chamber 12 of vacuum-operated actuator 7. In this manner, during the output operation of the engine, vacuum is stored in the vacuum chamber 12 and the diaphragm 10 therein is held drawn to the right, as viewed in the drawing.

In such situations, when the throttle valve 4 is released from the valve-operating force, it starts to close quickly under the bias of a return spring, not shown, but immediately thereafter when it reaches its predetermined limited-opening position, its closing movement is interrupted as it is placed in operative connection with the diaphragm 10 in the vacuum-operated actuator 7, which is in an operated position. At this stage, however, the throttle valve 4 is already on the downstream side of the first vacuum outlet port $13_1$ and the vacuum at the latter is at a value much lower than that in the vacuum chamber 12, thus causing air flow through the first vacuum passage $14_1$ and vacuum feed passage 15 in the direction toward the vacuum chamber 12. The rate of such air flow, allowed through the orifice 24 provided in unidirectional valve 25, is limited and the throttle valve 4 once brought to a stop is allowed to close only at a correspondingly limited rate to its normal idling position.

THE SECOND FUNCTION

When the engine is in a warmed-up state at an oridinary elevated operating temperature, for example, the engine coolant is at 70° C. or above, the engine-temperature responsive switch 22 remains closed, sensing such engine temperature condition. When the engine in such condition is started, the main switch 23 and also the engine-start responsive switch 21 are closed so that the solenoid 18 is energized by current from voltage source 19 and the switching valve 16 is operated to open the second vacuum passage $14_2$. Accordingly, the intake vacuum produced on the downstream side of the throttle valve 4 as the engine is cranked by an appropriate starter unit, not shown, is fed through the second vacuum passage $14_2$ and vacuum feed passage 15 into the vacuum chamber 12 in the vacuum-operated actuator 7 so that the diaphragm 10 therein is drawn to the right, as viewed in the drawing, to open the throttle valve 4 to its predetermined limited-opening position. At this time, any pulsation of the intake vacuum flowing through the second vacuum passage $14_2$ is smoothed down under the combined effect of the unidirectional valve 26 and orifice 27. This means that the vacuum chamber 12 is fed with the vacuum free of any undesirable fluctuations and the throttle valve 4 can be held stable in the limited-opening position. As a consequence, the amount of air flowing past the throttle valve 4 is increased to a level higher than the obtainable with the throttle valve as held in the idling position and thus, preventing any excessive fuel enrichment, yields a mixture of optimal air fuel ratio. As will be readily noted, such mixture enables the started engine to rapidly undergo a normal full-firing condition.

Once the engine is started, the engine-start responsive switch 21 is opened to de-energize the solenoid 18 and the switching valve 16 is restored to its normal position to hold open the first vacuum passage $14_1$. On the other hand, in the limited-opening position of throttle valve 4, the first vacuum outlet port $13_1$ is still on the upstream side of the adjacent edge of throttle valve 4 and the vacuum at the port $13_1$ is lower than that in the vacuum chamber 12. Upon restoring, therefore, of the switching valve 16, air flow is started through the first vacuum passage $14_1$ and vacuum feed passage 15 in the direction toward the vacuum-operated actuator 7. Such air flow, however, is restricted by the orifice 27, allowing the throttle valve 4 to close slowly to the idling throttle position, and engine stall due to rapid closing of the throttle valve 4 to the idling throttle position is effectively prevented.

To summarize, according to the present invention, a vacuum-operated throttle actuator, previously utilized to correct the throttle opening in increasing direction for the purpose of reducing the amount of unburned products in the exhaust gases when the engine is slowing down or of improving the idling performance of the engine, is adapted to serve the additional function of suppressing any undesirable fuel enrichment automatically without necessitating any troublesome throttle operation on the part of the driver when the engine is restarted at an elevated temperature condition, thus enabling the engine to be started easily without fail despite its temperature condition. The apparatus of the present invention is simple in structure and its fabrication cost can be materially reduced with the use of any existing vacuum-operated actuator.

What is claimed is:

1. In an internal combustion engine having an intake system with an adjustable throttle valve therein and apparatus for expediting the hot-starting of the engine comprising a vacuum-operated actuator connected to the throttle valve to open the valve to a predetermined throttle position, said actuator having a vacuum chamber connected by a vacuum passage to a port located in the intake system such that suction in the intake system acts on the vacuum chamber to cause the actuator to open the throttle valve during engine operation, the improvement comprising a second vacuum passage extending from a second port located in said intake system to said vacuum chamber, and switch means controlling selective connection of said first vacuum passage and said second vacuum passage to said vacuum chamber of said actuator, said switch means being operable to selectively connect said second vacuum passage to said vacuum chamber when the engine is restarted after the engine has been warmed up and is at a predetermined elevated temperature, and to cut the connection of said second vacuum passage to the vacuum chamber after the engine has been restarted and simultaneously place said first passage into connection with the vacuum chamber.

2. The improvement as claimed in claim 1 wherein said second outlet port is located in said intake system downstream of the throttle valve.

3. The improvement as claimed in claim 2 wherein said switch means comprises an electromagnetic switching valve.

4. The improvement as claimed in claim 3 wherein said switching valve comprises means for normally holding said valve open in a position in which said first passage is in communication with said vacuum chamber of the actuator.

5. The improvement as claimed in claim 4 wherein said switch means includes a power source and switches controlling energization of said switching valve to disconnect said first passage from said vacuum chamber and to connect said second passage to said vacuum chamber.

6. The improvement as claimed in claim 5 wherein said switches include a first switch responsive to engine starting and a second switch responsive to said predetermined elevated temperature of the engine, said first and second switches being connected in series between said switching valve and said power source.

7. The improvement as claimed in claim 2 comprising a unidirectional valve means in said second passage permitting air flow only in the direction from said vacuum chamber to said second port.

8. The improvement as claimed in claim 2 comprising an orifice in said second passage for eliminating pulsation effects therein.

9. In an internal combustion engine having an intake system with an adjustable throttle valve therein and apparatus for expediting the hot-starting of the engine comprising a vacuum-operated actuator connected to the throttle valve to open the valve to a predetermined throttle position, said actuator having a vacuum chamber connected by a vacuum passage to a port located in the intake system such that suction in the intake system acts on the vacuum chamber to cause the actuator to open the throttle valve during engine operation, the improvement comprising a method including the steps of sensing engine temperature, operating the actuator to open the throttle valve to a more open throttle position than its normal idling position when the engine is restarted after the engine has been warmed up and is at a predetermined elevated temperature and returning the throttle valve to its normal idling position after the hot engine has been restarted.

10. The method as claimed in claim 9 comprising selectively operating the actuator in response to the vacuum prevailing in the intake passage at said port or at a second port located downstream of the throttle valve in accordance with the temperature of the engine, the actuator being subjected to the vacuum prevailing at the second port only until the hot engine has been restarted.

11. The method as claimed in claim 10 wherein the temperature of the engine is established by a switch which is closed when the temperature of the engine coolant reaches a predetermined value and the starting of the engine is established by a second switch connected in series with the first switch.

* * * * *